US007241203B1

(12) United States Patent
Chen et al.

(10) Patent No.: US 7,241,203 B1
(45) **Date of Patent: *Jul. 10, 2007**

(54) SIX HEADED CAROUSEL

(75) Inventors: Hung Chih Chen, Sunnyvale, CA (US); Simon Yavelberg, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/608,588

(22) Filed: Dec. 8, 2006

Related U.S. Application Data

(63) Continuation-in-part of application No. 11/437,765, filed on May 18, 2006, now Pat. No. 7,166,016.

(51) Int. Cl.
*B24B 7/00* (2006.01)

(52) U.S. Cl. ..... 451/11; 451/67; 451/283; 451/339

(58) Field of Classification Search ..... 451/11, 451/283, 285, 286, 287, 288, 289, 339, 65, 451/67, 914; 156/345.12; 438/692
See application file for complete search history.

(56) References Cited

U.S. PATENT DOCUMENTS

| | | | | |
|---|---|---|---|---|
| 4,141,180 | A | 2/1979 | Gill, Jr. et al. | |
| 5,738,574 | A * | 4/1998 | Tolles et al. | 451/288 |
| 5,804,507 | A * | 9/1998 | Perlov et al. | 438/692 |
| 5,993,302 | A | 11/1999 | Chen et al. | |
| 6,086,457 | A | 7/2000 | Perlov et al. | |
| 6,156,124 | A | 12/2000 | Tobin | |
| 6,159,079 | A | 12/2000 | Zuniga et al. | |
| 6,183,354 | B1 | 2/2001 | Zuniga et al. | |
| 6,293,845 | B1 * | 9/2001 | Clark-Phelps | 451/5 |
| 6,629,883 | B2 | 10/2003 | Katsuoka et al. | |
| 6,705,932 | B1 | 3/2004 | Zuniga et al. | |
| 6,951,597 | B2 | 10/2005 | Korovin | |
| 6,969,305 | B2 | 11/2005 | Kimura et al. | |
| 2002/0177386 | A1 | 11/2002 | Smith | |
| 2004/0003894 | A1 * | 1/2004 | Hsu et al. | 156/345.12 |
| 2004/0020789 | A1 | 2/2004 | Hu et al. | |
| 2004/0023495 | A1 | 2/2004 | Butterfield et al. | |
| 2004/0023610 | A1 | 2/2004 | Hu et al. | |
| 2004/0127142 | A1 | 7/2004 | Olgado | |
| 2004/0266085 | A1 * | 12/2004 | Hsu et al. | 438/200 |
| 2005/0000801 | A1 | 1/2005 | Wang et al. | |
| 2005/0037698 | A1 | 2/2005 | Zuniga et al. | |
| 2005/0142993 | A1 | 6/2005 | Chen et al. | |
| 2005/0176349 | A1 | 8/2005 | Yilmaz et al. | |
| 2005/0211377 | A1 | 9/2005 | Chen et al. | |
| 2006/0035583 | A1 | 2/2006 | Kalenian et al. | |

* cited by examiner

*Primary Examiner*—Jacob K. Ackun, Jr.
(74) *Attorney, Agent, or Firm*—Patterson & Sheridan

(57) ABSTRACT

The present invention relates to an apparatus and method for polishing semiconductor substrates with improved throughput and reduced foot print. One embodiment of the present invention provides an apparatus for polishing a substrate. The apparatus comprises a base, four polishing stations disposed on the base, two load cups disposed on the base, a first wash station disposed on the base adjacent to the first of the four polishing station, and a carousel rotatable about a carousel axis and supported by the base, wherein the carousel comprises six substrate heads alignable to any of the four polishing stations, the two load cups and the first wash station.

22 Claims, 7 Drawing Sheets

SIX HEADED CAROUSEL

CROSS-REFERENCE TO RELATED APPLICATIONS

This application is a continuation-in-part of a U.S. patent application Ser. No. 11/437,765, filed May 18, 2006 now U.S. Pat. No. 7,166,016, entitled "Six Headed Carousel", which is incorporated herein by reference.

BACKGROUND OF THE INVENTION

1. Field of the Invention

Embodiments of the invention generally relate to an apparatus and method for polishing or planarization of semiconductor substrates.

2. Description of the Related Art

Sub-micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features. Reliable formation of these interconnect features is very important to the success of ULSI and to the continued effort to increase circuit density and quality on individual substrates and die.

In the fabrication of integrated circuits and other electronic devices, multiple layers of conductive, semiconductive, and dielectric materials are deposited on or removed from a surface of a substrate. Thin layers of conductive, semiconductive, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electro-chemical plating (ECP).

As layers of materials are sequentially deposited and removed, the uppermost surface of the substrate may become non-planar across its surface and require planarization. An example of non-planar process is the deposition of copper films with the ECP process in which the copper topography simply follows the already existing non-planar topography of the wafer surface, especially for lines wider than 10 microns. Planarizing a surface, or "polishing" a surface, is a process where material is removed from the surface of the substrate to form a generally even, planar surface. Planarization is useful in removing undesired surface topography and surface defects, such as rough surfaces, agglomerated materials, crystal lattice damage, scratches, and contaminated layers or materials. Planarization is also useful in forming features on a substrate by removing excess deposited material used to fill the features and to provide an even surface for subsequent levels of metallization and processing.

Planarization is generally performed using Chemical Mechanical Polishing (CMP) and/or Electro-Chemical Mechanical Deposition (ECMP). A planarization method typically requires that the substrate be mounted in a wafer head, with the surface of the substrate to be polished exposed. The substrate supported by the head is then placed against a rotating polishing pad. The head holding the substrate may also rotate, to provide additional motion between the substrate and the polishing pad surface. Further, a polishing slurry (typically including an abrasive and at least one chemically reactive agent therein, which are selected to enhance the polishing of the topmost film layer of the substrate) is supplied to the pad to provide an abrasive chemical solution at the interface between the pad and the substrate.

The combination of polishing pad characteristics, the specific slurry mixture, and other polishing parameters can provide specific polishing characteristics. Thus, for any material being polished, the pad and slurry combination is theoretically capable of providing a specified finish and flatness on the polished surface. It must be understood that additional polishing parameters, including the relative speed between the substrate and the pad and the force pressing the substrate against the pad, affect the polishing rate, finish, and flatness. Therefore, for a given material whose desired finish is known, an optimal pad and slurry combination may be selected. Typically, the actual polishing pad and slurry combination selected for a given material is based on a trade off between the polishing rate, which determines in large part the throughput of wafers through the apparatus, and the need to provide a particular desired finish and flatness on the surface of the substrate.

Because the flatness and surface finish of the polished layer is dictated by other processing conditions in subsequent fabrication steps, throughput insofar as it involves polishing rate must often be sacrificed in this trade off. Nonetheless, high throughput is essential in the commercial market since the cost of the polishing equipment must be amortized over the number of wafers being produced. Of course, high throughput must be balanced against the cost and complexity of the machinery being used. Similarly, floor space and operator time required for the operation and maintenance of the polishing equipment incur costs that must be included in the sale price. For all these reasons, a polishing apparatus is needed which has high throughput, is relatively simple and inexpensive, occupies little-floor space, and requires minimal operator control and maintenance.

Multiple polishing steps have been used for polishing the substrate to thereby allow improved polishing rate and finish with multiple pad or slurry combinations, hence increasing throughput.

One method provides a main polishing surface and a fine polishing surface in a polishing apparatus. A single polishing head, controlled by a single positioning apparatus, moves a single substrate between the different polishing stations on the apparatus. However, at least one polishing surface is idle at any given time.

Another method provides multiple polishing pads, each pad corresponding to a polishing head, and a substrate handling device moving the substrate being processed among the polishing pads and heads. However, multiple loading and unloading of substrates limits the throughput and also increases the possibility of particle contamination.

Another method of increasing throughput uses a wafer head having a plurality of substrate loading stations therein to simultaneously load a plurality of substrates against a single polishing pad to enable simultaneous polishing of the substrates on the single polishing pad. Although this method would appear to provide substantial throughput increases over the single substrate style of wafer head, several factors militate against the use of such carrier arrangements for planarizing substrates, particularly after deposition layers have been formed thereon. First, the wafer head holding the wafer being polished is complex. To attempt to control the force loading each substrate against the pad, one approach floats the portion of the head holding the wafer. A floating wafer holder necessitates a substantial number of moving parts and pressure lines must be included in the rotating and moving geometry. Additionally, the ability to control the forces pressing each individual substrate against the pad is limited by the floating nature of such a wafer head assembly, and therefore is a compromise between individual control and ease of controlling the general polishing attributes of the multiple substrates. Finally, if any one substrate develops a problem, such as if a substrate cracks, a broken piece of the substrate may come loose and destroy all of the other substrates being polished on the same pad.

Polishing throughput is yet further limited by the requirement that wafers be washed at the end of polishing and between stages of polishing especially when non-compatible polishing solutions are used in different polishing stages. Although washing time has been limited in the past by simultaneously washing multiple wafer head, insofar as the washing requires additional machine time over that required for polishing, system throughput is adversely affected.

Therefore, there is a need for a polishing apparatus which enables optimization of polishing throughput.

SUMMARY OF THE INVENTION

The present invention provides methods and apparatus for polishing semiconductor substrates with improved throughput. Particularly, the present invention provides apparatus and methods for performing multistage polishing to semiconductor substrates.

One embodiment provides an apparatus for polishing a substrate comprising a base, four polishing stations disposed on the base, two load cups disposed on the base, a wash station disposed on the base adjacent to one of the four polishing station, and a carousel rotatable about a carousel axis and supported by the base, wherein the carousel comprises six substrate heads, each configured to receive and support the substrate, and each of the six substrate heads alignable to any of the four polishing stations, the two load cups and the wash station, wherein the carousel is configured to simultaneously align the six substrate heads with the four polishing stations and the two load cups.

Another embodiment of the present invention provides a polishing system comprising a base, four polishing stations disposed on the base, two load cups disposed on the base, a first wash station and a second wash station positioned on the base, a carousel rotatable about a carousel axis and supported by the base, wherein the carousel comprises six substrate heads, each configured to receive and support a substrate, and each of the six substrate heads alignable to any of the polishing stations, load cups, and the wash stations.

Yet another embodiment of the present invention provides a method for polishing substrate comprising providing a polishing system having at least six substrate heads mounted on a carousel, loading a substrate on one of the substrate heads aligned with a load cup, aligning the substrate with a polishing station, polishing the substrate in the polishing station, moving the substrate head radially to align with a wash station, and washing the substrate in the wash station.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention provides methods and apparatus for polishing semiconductor substrates with improved throughput. Embodiments of the present invention especially provide method and apparatus for multistage polishing that requires non-compatible polishing solutions.

Figure 1:
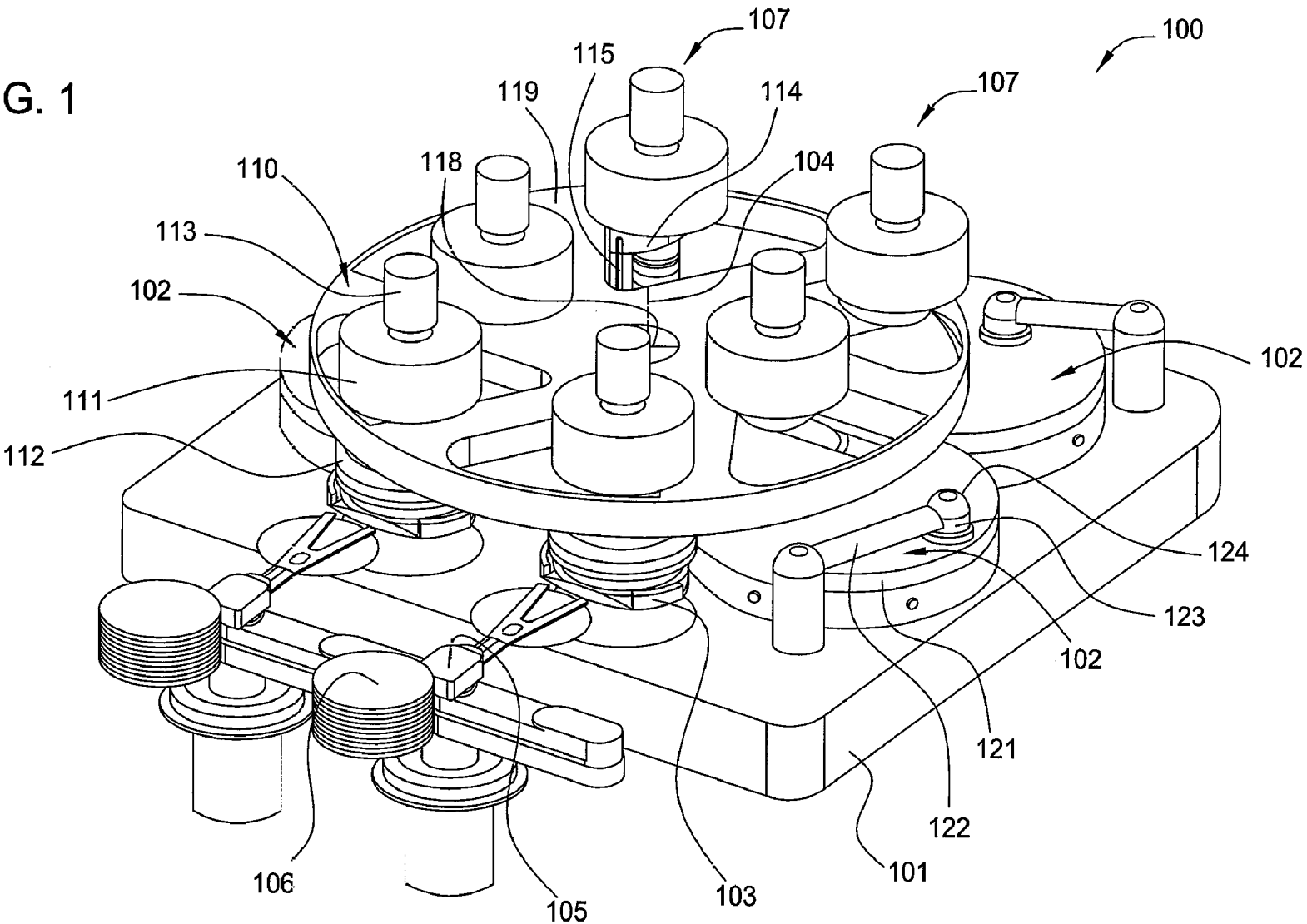
FIG. 1 illustrates a perspective view of a polishing system in accordance with one embodiment of the present invention.

FIG. 1 illustrates a perspective view of a polishing system 100 in accordance with one embodiment of the present invention.

The polishing system 100 is configured to conduct multiple step polishing and/or batch polishing. The polishing system 100 generally comprises a base 101 that support multiple polishing stations 102, one or more load cups 103, and a carousel 110. In one embodiment, four polishing stations 102 and two load cups 103 are generally disposed on the base 101. The carousel 110 comprises six head systems 107 configured to receive, transfer and process substrates. The polishing stations 102 and the load cups 103 are disposed in a circular manner with the load cups 103 next to each other. One or more robot 105 configured to transfer substrates between the load cups 103 and cassettes 106 may be positioned approximate the load cups 103.

Each polishing station 102 includes a rotatable platen 121 on which a polishing pad 124 is placed. Each polishing station 102 further includes a conditioner head 123 adapted on a rotatable arm 122. A detailed description for the rotatable platen 121 and the polishing pad 124 may be found in co-pending U.S. patent application Ser. No. 10/880,752, filed on Jun. 30, 2004, entitled "Method and Apparatus for Electrochemical Mechanical Processing", published as United States Patent Application Publication No. 2005-0000801, which is herein incorporated as reference. A detailed description for the polishing pad 124 may be found in co-pending U.S. patent application Ser. No. 10/455,895, filed on Jun. 6, 2003, entitled "Conductive Polishing Article for Electrochemical Mechanical Polishing", published as United States Patent Application Publication No. 2004-0020789, which is herein incorporated as reference. Each of the polishing stations 102 may be configured to conduct chemical mechanical polishing (CMP), electrochemical mechanical polishing (ECMP) or buffing.

In one embodiment, the carousel 110 comprises six head systems 107. Each of the head systems 107 is configured to receive one substrate, transfer the substrate among the polishing stations 102 and the load cups 103, and polish the substrate by pressing the substrate against any one of the polishing pads 124 on the polishing stations 102. In one embodiment, the carousel 110 is supported by a center post 118 on the base 101. The carousel 110 is rotatable on the center post 118 about a carousel axis 104 by a motor assembly (not shown) located within the base 101. In one embodiment, the motor assembly may comprise a servo motor.

In one embodiment, the six head systems 107 are identical and mounted on a carousel base plate 119 at equal angular intervals about the carousel axis 104. The center post 118 supports the carousel base plate 119 and allows the motor assembly to rotate the carousel base plate 119.

Each head system 107 comprises a substrate head 112 which is rotatable about its own axis 113 by a head-rotation motor 111 connected to the substrate head 112 by a shaft. The substrate heads 112 can rotate independently driven by the respective head-rotation motor 111. Each head system 107 is independently movable along a slot 116 formed radially on the carousel base plate 119. In one embodiment, for each head system 107, the linear movement along the respectively slot 116 is realized through a slide 114 mounted around the shaft between the head-rotation motor 111 and the substrate head 112. In one embodiment, each slide 114 is connected to a lead screw 115 driven by a sweeping motor 117 (shown in FIG. 2) disposed near the center post 118. In one aspect, the linear movement along the slots 116 may be performed in an oscillating manner to provide the respective substrate head 112 a sweeping motion relative to the polishing station 102 during polishing. In another aspect, the linear movement along the slots 116 enables each head system 107 to get aligned with the polishing stations 102 and load cups 103 which are not centered in a perfect hexagon to reduce the foot print (further described for FIG. 2).

During process, four of the six head systems 107 are positioned above a respective polishing station 102 in a nonconcentric manner. The substrate retained on each substrate head 112 is lowered using substrate lowering/raising mechanism within the head system 107. Polishing is conducted via a relative motion produced between the substrate retained therein and the platen 121 of the respective polishing station 102. In one embodiment, the relative motion may be a result of a rotation of the platen 121, a rotation of the substrate head 112 and/or a sweeping motion of the substrate head 112. A suitable head system may be a Titan(D polishing head available from Applied Materials, Inc. located in Santa Clara, Calif. A detailed description of the substrate head 112 may be found in U.S. Pat. No. 6,183,354, entitled "Carrier Head with a Flexible Membrane for a Chemical Mechanical Polishing", and co-pending U.S. patent application Ser. No. 11/054,128 filed on Feb. 8, 2004, entitled "Multi-chamber Carrier Head with a Flexible Membrane", published as United States Patent Application Publication No. 2005-0142993, which are herein incorporated as reference.

The load cups 103 are positioned on the base 101 such that when four of the six head systems 107 are in polishing position above a respective polishing station 102, the other two head systems 107 may be aligned to the two load cups 103 respectively. Each load cup 103 is configured to receive/pass a substrate from/to the robot 105, pass/receive the substrate to/from each of the head systems 107. In one embodiment, the load cups 103 may be also adapted to be a wash station for a substrate to be cleaned therein. A detailed description of a load cup may be found in co-pending U.S. patent application Ser. No. 10/988,647, filed on Nov. 15, 2004, entitled "Load Cup for Chemical Mechanical Polishing", published as United States Patent Application Publication No. 2005-0176345, which is herein incorporated as reference.

Figure 2:
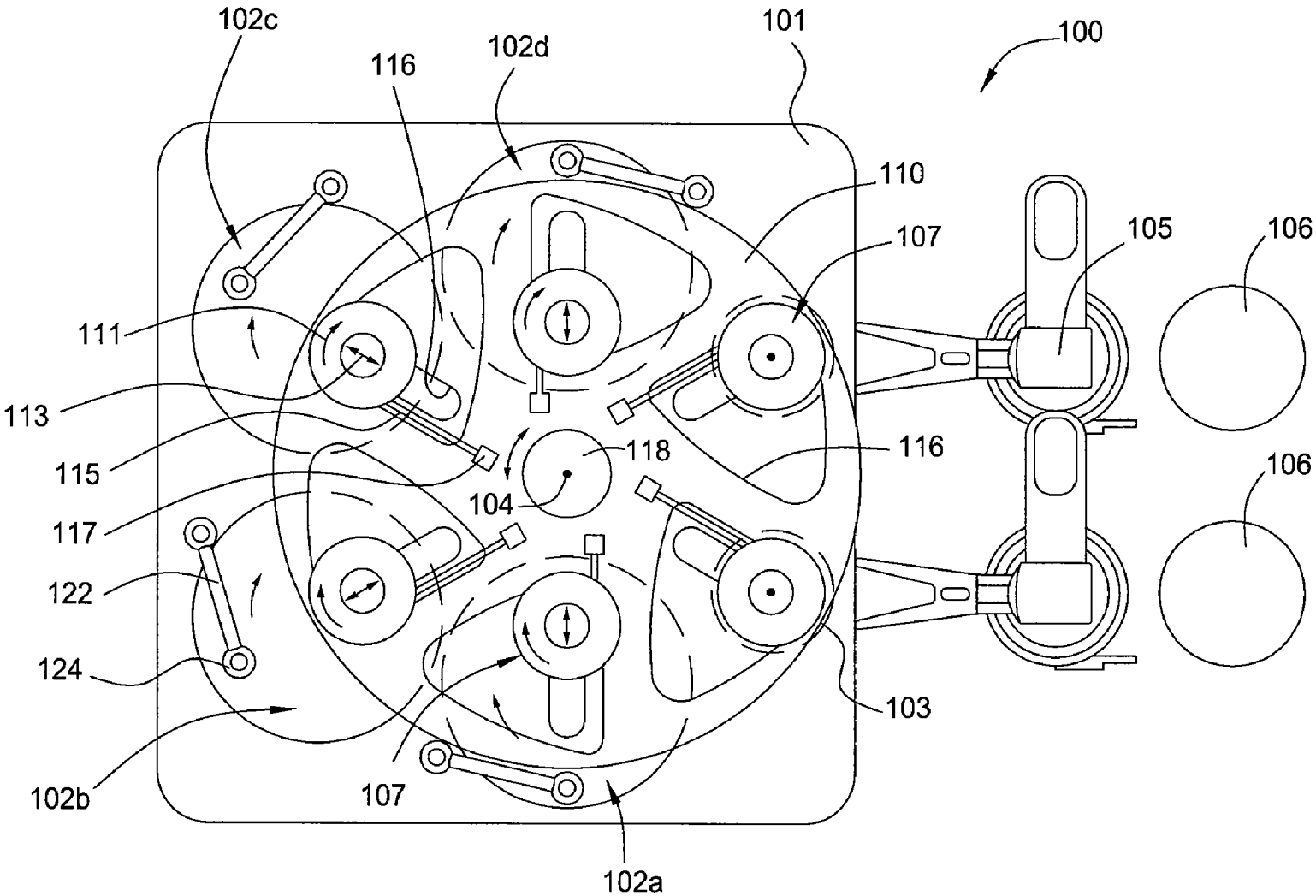
FIG. 2 illustrates a schematic top view of the polishing system shown in FIG. 1.

FIG. 2 illustrates a top view of the polishing system 100 of in FIG. 1 in a polishing position. In one embodiment, foot print of the polishing system 100 may be minimized by using variable working positions for each head system 107 among the polishing stations 102 and the load cups 103. In one embodiment, the variation of working positions for each head system 107 may be realized by sliding radially along the corresponding slot 116. As shown in FIG. 2, when the head system 107 is above the polishing stations 102*a* and 102*d*, the head system 107 works near the carousel axis 104 by sliding radially inward along the corresponding slot 116. On the other hand, when the head system 107 is above the polishing stations 102*b* and 102*c*, the head system 107 works far away from the carousel axis 104 by sliding radially outward along the corresponding slot 116. In the configuration, center of the polishing stations 102*a-d* and the load cups 103 are positioned in a non symmetric hexagon (not a perfect hexagon) for the six headed carousel 110. The polishing stations 102*a* and 102*d* are positioned relatively inward to minimize the foot print, therefore, saving space in the cleanroom and improving cost of ownership. In one embodiment, the polishing stations 102 may have a diameter of about 762 mm (30 inches) for processing 300 mm substrates.

As discussed in the background, polishing characteristics are determined by combination of polishing pad characteristics, specific slurry mixtures, and other polishing parameters. Each of the polishing stations 102 may be configured to performed different polishing effect according to the requirement. In one embodiment, the polishing stations 102 may have the same setting to performed a one step batch processing. In another embodiment, the polishing stations 102 may be set in a sequence that conducts four different polishing steps, e.g. bulk material removal, fine polishing, barrier layer polishing, and buffing. In another embodiment, the polishing stations 102 may be configured to perform a two step polishing wherein two polishing stations may perform the same polishing steps.

During process, a substrate to be processed is generally transferred from the cassette 106 to one of the load cups 103 by one of the robots 105. After the robot 105 drops off the substrate on the load cup 103, the carousel 110 may rotate so that a particular head system 107 is right above the load cup 103 with the substrate to be processed if the particular head system 107 is not already in position. In one embodiment, the particular head system 107 may need to slide along the corresponding slot 116 to be in position for picking up the substrate on the load cup 103. In another embodiment, the load cup 103 may be movable to complete the alignment between the head system 107 and the load cup 103. A detailed method of alignment may be found in co-pending U.S. Provisional Patent Application No. 60/810,350, filed Jun. 2, 2006, entitled "Rotational Alignment Mechanism for New Load Cup", which is herein incorporated as reference. When in position, the head system 107 generally lowers the substrate head 112 to load the substrate on the substrate head 112.

After the substrate to be processed has been loaded on the substrate head 112, the substrate head 112 raised up. When all six head systems 107 of the carousel 110 are ready, e.g., polishing is finished, and loading is completed, the carousel 110 may rotate by an increment of 60° to position the head system 107 with the substrate to be processed in one of the polishing stations 102. The head system 107 may then slide along the slot 116 to a working position corresponding to the polishing station 102 and lower the substrate head 112 to apply a pressure between the substrate to be processed and the polishing pad 124 of the polishing station 102 and start a polishing process. During polishing, the polishing station 102 and the substrate head 112 both rotates about their center axis. Because the center axis of the polishing station 102 and the substrate head 112 are offset, the rotations of the polishing station 102 and the substrate head 112 generate a relative motion between the polishing station 102 and the substrate head 112, hence, generating a relative motion between the polishing pad 124 and the substrate to be processed. In one embodiment, the rotations of the polishing station 102 and the head 112 are of the same direction, for example, both clock wise or both counter clock wise. In another embodiment, the head system 107 also performs a sweeping motion by oscillating about the polishing position driven by the sweeping motor 117. The sweeping motion provides a uniform polishing rate across the substrate to be processed.

For a one step polishing, the substrate may be rotate in 60° increments in one or more steps to the load cups 103 to be unloaded after the polishing is completed. In one embodiment, both of the two load cups 103 are configured to load and unload a substrate. In another embodiment, one of the two load cups 103 is configured to load unprocessed substrates, while the other load cup 103 is configured to unload processed substrates. To unload the substrate, the head system 107 first align with the load cup 103, then lower the substrate head 112 down and drop off the substrate on the load cup 103, and raise the substrate head 112. The substrate may then be picked up by the robot 105 and transferred to the cassette 106.

For a multiple step processing, the substrate may be rotated and aligned with the polishing station 102 where a sequential polishing step is to be performed. Again, the substrate head 112 will be lowered down to perform a polishing step and raised up after the polishing step is done. The substrate is then rotated in sequence to the polishing stations 102 where the remaining polishing steps are to be performed. When all the polishing steps are completed, the carousel 110 will rotate to align the head system 107 having the substrate with the load cup 103 where unloading is to be performed.

Polishing systems similar to the polishing system 100 may be used to improve performance and throughput of batch polishing or multiple step processing. However, solution contamination may occur among the polishing stations when perform a multiple step polishing using non-compatible processing solutions in different polishing steps. FIGS. 3 to 6 illustrates embodiments of polishing systems that may be used to avoid or minimize solution contamination between polishing stations.

Figure 3:
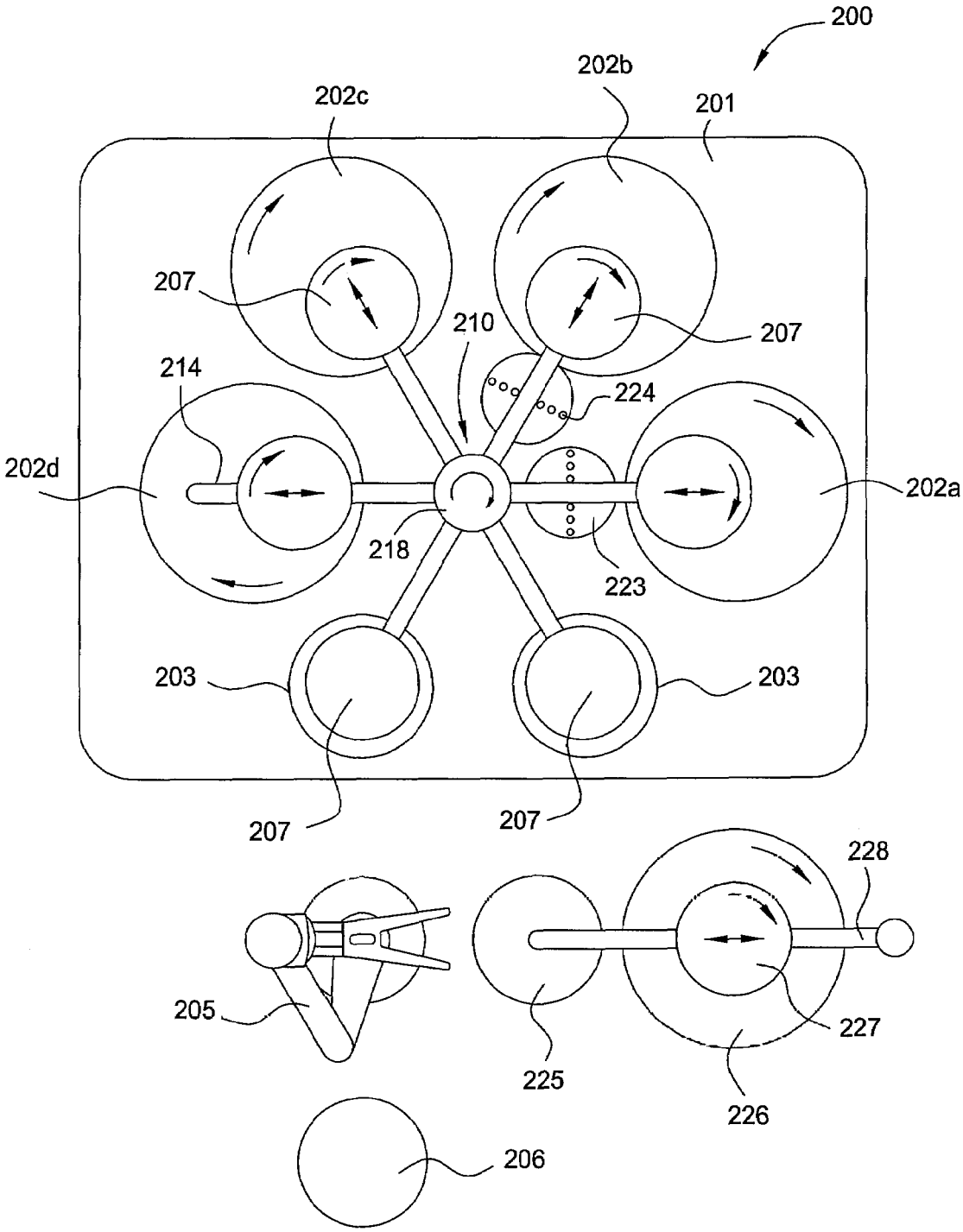
FIG. 3 illustrates a schematic top view of a polishing system in accordance with one embodiment of the present invention.

FIG. 3 illustrates a schematic top view of a polishing system 200 in accordance with another embodiment of the present invention. The polishing system 200 has similar constructions to the polishing system 100 of FIGS. 1 and 2 except that at least one polishing station of the polishing system 200 has a wash station disposed nearby so that a substrate head can move between the polishing station and the wash station without affecting alignment of other substrate heads mounted on the carousel.

The polishing system 200 comprises multiple polishing stations 202, one or more load cups 203 mounted on a base 201. A carousel 210 configured to support a plurality of substrate heads 207 is disposed above the base 201 so that the plurality of substrate heads 207 may be aligned with the multiple polishing stations 202 and the one or more load cups 203. The carousel 210 is rotatable about a carousel axis 218. In one embodiment, the carousel axis 218 is mounted on the base 201 and the multiple polishing stations 202 and the one or more load cups 203 are disposed in a circular manner around the carousel axis 218. In one embodiment, the polishing system 200 comprises four polishing stations 202 and two load cups 203.

The plurality of substrate heads 207 are disposed around the carousel axis 218 on the carousel 210. A plurality of supporting beams 214 are shown as supporting structures for the substrate heads 207 for clear illustration of structures underneath the carousel 210. Suitable structures, such as the mechanism in the carousel 110 of FIG. 1, may be used in place of the supporting beams 214. In one embodiment, the plurality of substrate heads 207 is disposed around the carousel axis 218 at equal angular intervals. Each of the plurality of substrate heads 207 is configured to receive and transfer a substrate among the polishing stations 202 and the load cups 203. Each substrate heads 207 is also configured to rotate the substrate around its center and polish the substrate by pressing the substrate against any one of the polishing stations 202. Each of the substrate heads 207 is radially movable. In one embodiment, the radial movement of each substrate heads 207 may be afforded by a linear mechanism on the supporting beams 214. In one aspect, the radial movement of each substrate head 207 may provide a sweeping movement during polishing to improve polishing uniformity. In another aspect, the radial movement of each substrate head 207 allows the substrate head 207 to be aligned with polishing stations and load cups that are distributed at different distances from the carousel axis 218, therefore, improving design flexibility.

The at least one wash station 223 may be disposed on the base 201. In one embodiment, the at least one wash station 223 is positioned such that when the carousel 210 is in an aligned position, i.e. each of the substrate head 207 is alignable with a polishing station 202 or a load cup 203 without rotation of the carousel 210, while a substrate head 207 aligned with a polishing station 207 near the wash station 223 is also alignable with the wash station 223 by the radial movement of the substrate head 207. The configuration allows substrates being cleaned after or prior to a polishing step, hence, preventing cross contamination between polishing steps. This configuration is particularly useful when polishing solutions used in different polishing steps are not compatible.

As shown in FIG. 3, two wash stations 223 are disposed approximate two polishing stations 202*a* and 202*b*. The wash stations 223 are disposed inside a polygon formed by the polishing stations 202 and the load cups 203. During process, the substrate heads 207 aligned with the polishing station 202*a* and 202*b* may move radially inwards to align with the corresponding wash station 223.

In one embodiment, the wash station 223 may have a circular processing surface for cleaning a circular substrate obtained in a substrate head 207. In one embodiment, one or more spray nozzles 224 configured to spray a cleaning solution, such as dionized water, may be disposed on the circular processing surface. The one or more spray nozzles 224 are distributed such that a processing surface of the substrate is fully covered by the cleaning solution from the one or more spray nozzles. In one embodiment, the one or more spray nozzles 224 may be distributed across a radius of the circular processing surface. In one embodiment, the one or more spray nozzles 224 may be evenly spaced. In another embodiment, nine spray nozzles 224 are evenly distributed along a diameter of the circular processing surface. Other suitable arrangement of the spray nozzles 224 may be applied. During a cleaning process, the substrate head 207 may rotate the substrate over the wash station 223. In another embodiment, the wash station 223 may comprise a buffing pad on the circular processing surface. The buffing pad is configured to clean a substrate when contacting the substrate. In one embodiment, a relative movement may be provided between the substrate and the buffing pad. The relative movement may result from the rotation of the substrate head 207 and/or the wash station 223.

In one embodiment, the polishing system 200 may comprise a stand alone polishing station 226. The stand alone polishing station 226 may be disposed separately from the base 201 and the carousel 210. A substrate head 227 is mounted on a head support 228. In one embodiment, the substrate head 227 may move linearly between the stand alone polishing station 226 and a stand alone load cup 225 for loading, unloading and processing a substrate.

The polishing system 200 further comprises a robot 205 configured to transfer substrates among the load cups 203, the stand alone load cup 225 and one or more cassettes 206.

The stand alone polishing station 226 adds flexibility and improves throughput to the polishing system 200. For example, in a three step polishing process having two long steps and one short step, the short step may be conducted in the stand alone polishing station 226, while each of the two long steps may be performed by two polishing stations 202. The short step may be performed prior to or after the two long steps. An exemplary sequence of a two step polishing may be found in FIGS. 3A-F of the co-pending U.S. patent application Ser. No. 11/437,765, filed May 18, 2006, entitled "Six Headed Carousel", which is incorporated herein by reference.

Figure 4:
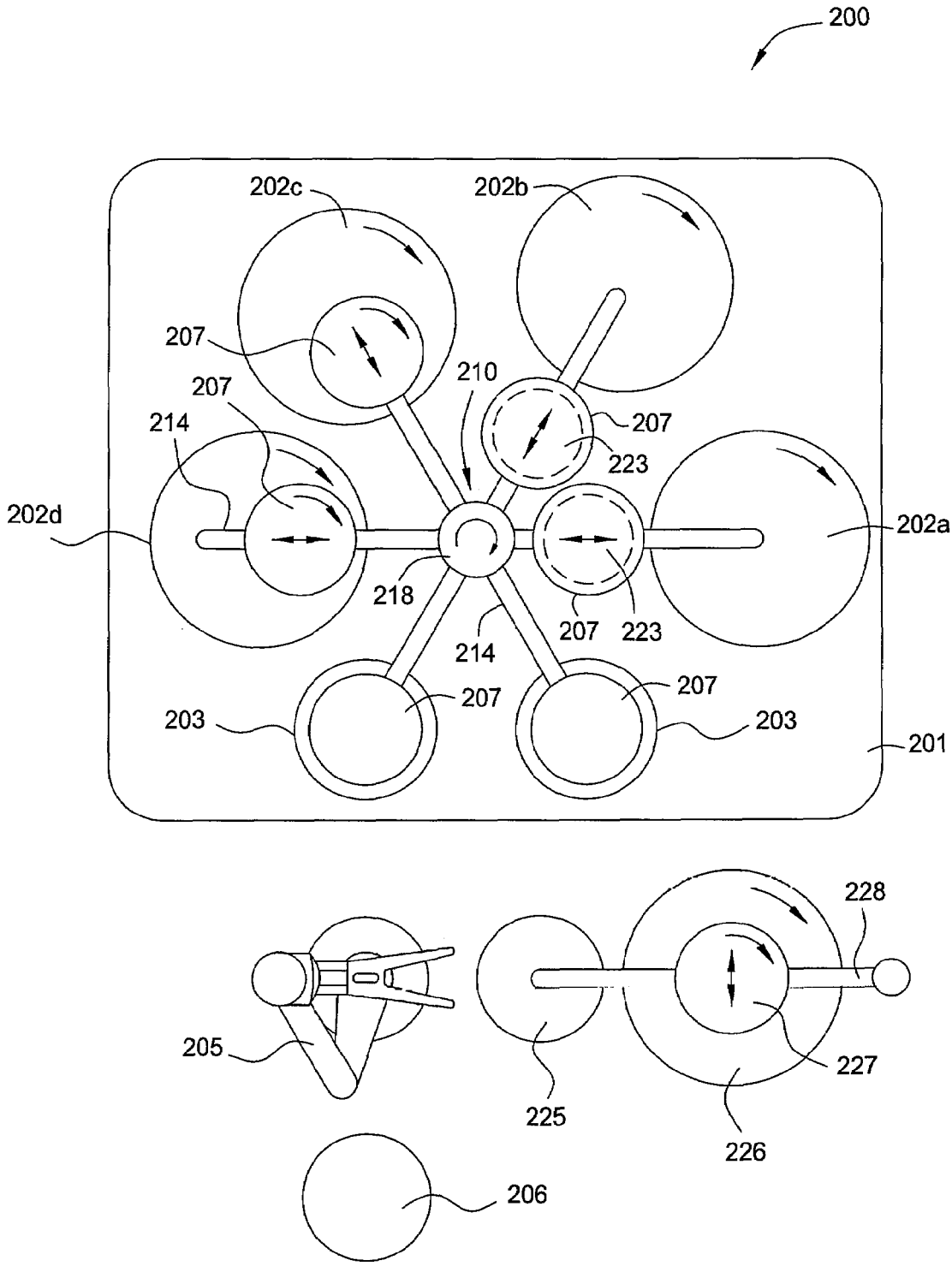
FIG. 4 illustrates a schematic top view of the polishing system of FIG. 3 in a washing position.

In one embodiment, a cleaning step may be conducted between the two long steps in the wash stations 223 to prevent polishing solution contamination. FIG. 4 illustrates the polishing system 200 in a position of conducting a cleaning step in the wash stations 223. The substrate heads 207*a*, 207*b*, 207*c* and 207*d* are in position of alignable with the polishing stations 202*a*, 202*b*, 202*c* and 202*d* respectively. While remaining in this alignment position, the substrate heads 207*a* and 207*b* are moved radially to align with the wash stations 223 where a cleaning step may be conducted as the substrate heads 207*c* and 207*d* are in the position of polishing substrates in the polishing station 223*c* and 223*d*. If the polishing step to be performed at polishing stations 202*c* and 202*d* takes longer than the total time needs for the polishing step to be performed at the polishing stations 202*a* and 202*b* and the cleaning step at the wash stations 223, the system throughput will not be reduced by the added cleaning step.

Figure 5:
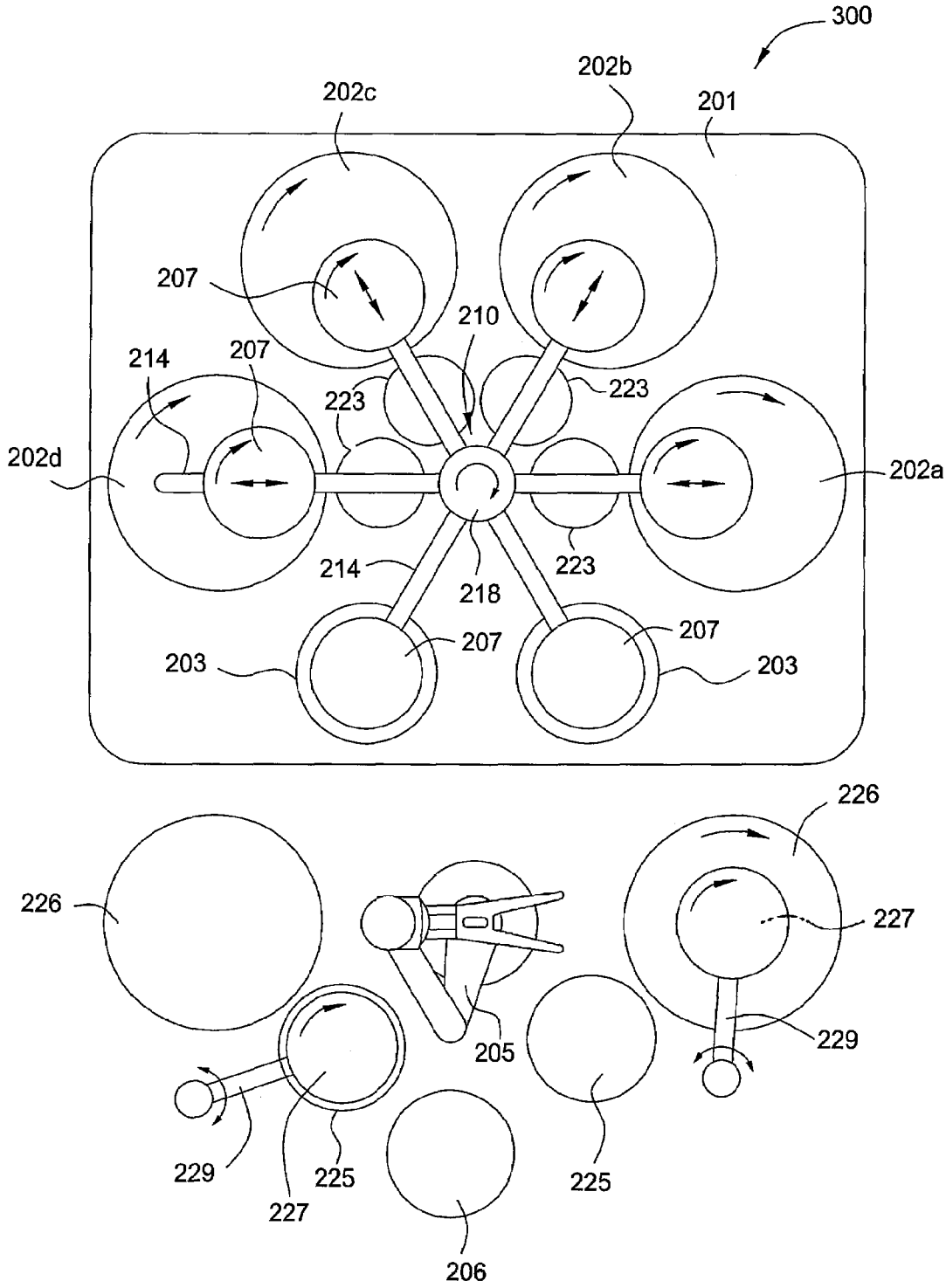
FIG. 5 illustrates a schematic top view of a polishing system in accordance with one embodiment of the present invention.

FIG. 5 illustrates a polishing system 300 having wash stations 223 positioned approximate each of the polishing stations 202 disposed on the base 201. In one embodiment, each of the wash stations 223 comprises a buffing pad for cleaning substrates. Two stand alone polishing stations 226 are disposed adjacent the base 201. The substrate heads 227 paired with each of the stand alone polishing stations 226 may be pivoted by a pivoting arm 229 back and forth between the stand alone polishing stations 226 and the load cups 225.

The polishing system 300 allows greater flexibility for polishing process with reduced foot print. A cleaning step may be performed between any two sequencing polishing steps. Additionally, the one or more load cups 203 and/or the stand alone load cup 225 may be adapted as wash stations to clean substrates aligned therein. A detailed description of a load cup that can be used as a wash station may be found in co-pending U.S. patent application Ser. No. 10/988,647, filed on Nov. 15, 2004, entitled "Load Cup for Chemical Mechanical Polishing", published as United States Patent Application Publication No. 2005-0176345, which is herein incorporated as reference. Therefore, additional cleaning steps may be performed during loading and/or unloading the substrate from the substrate heads 207 and/or the substrate heads 227 providing even greater processing flexibility. In the same manner, the stand alone load cup 225 may also be used as a wash station.

Figure 6:
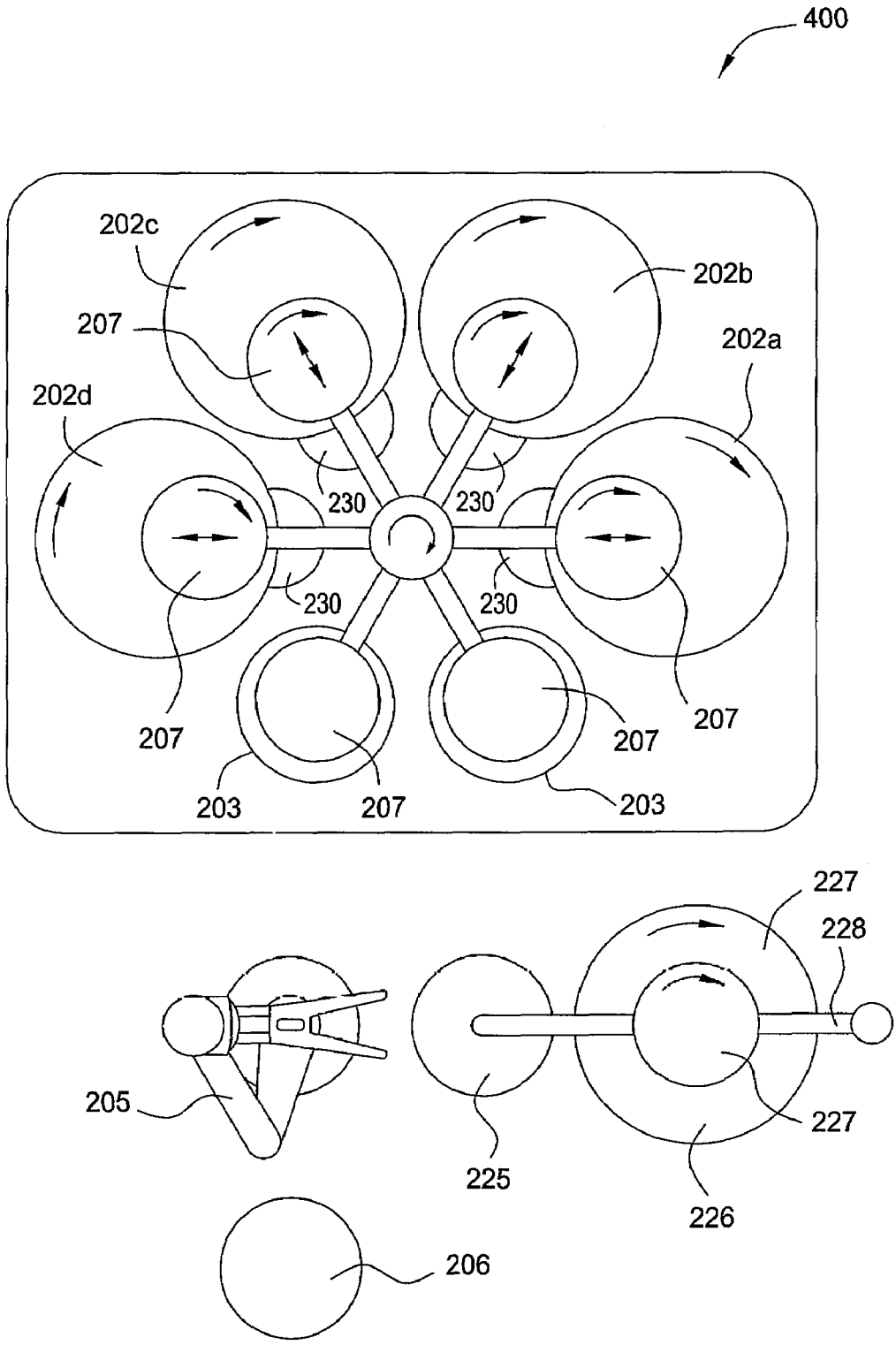
FIG. 6 illustrates a schematic top view of a polishing system in accordance with one embodiment of the present invention.

FIG. 6 illustrates a polishing system 400 having wash stations 230 positioned approximate each of the polishing stations 202 disposed on the base 201. Each of the wash stations 230 has a partial circular processing surface. Each of the wash stations 230 positioned right next to the corresponding polishing stations 202 such that a substrate being cleaned may be in contact with the partial circular processing surface of the wash station 230 and a polishing surface of the polishing station 202. The polishing system 400 has the same level of flexibility of the polishing system 300 with a further reduced foot print.

Figure 7A:
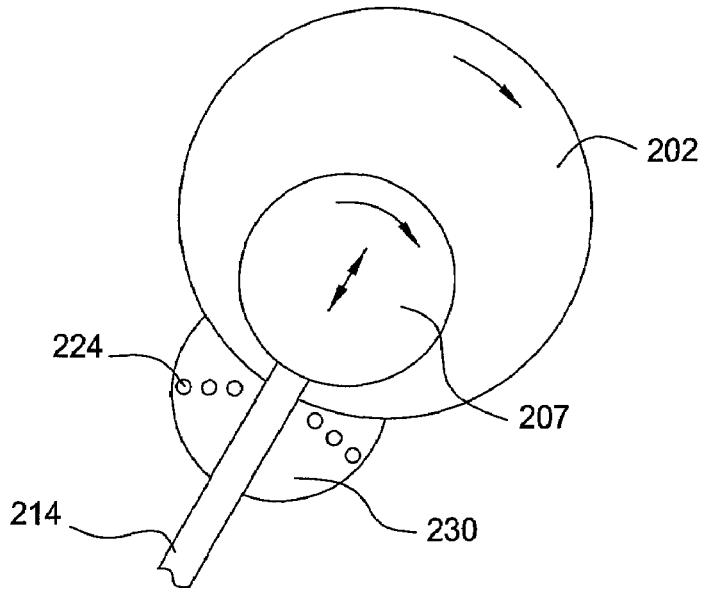
FIG. 7A illustrates a partial top view of the polishing system of FIG. 6 in a polishing position.
Figure 7B:
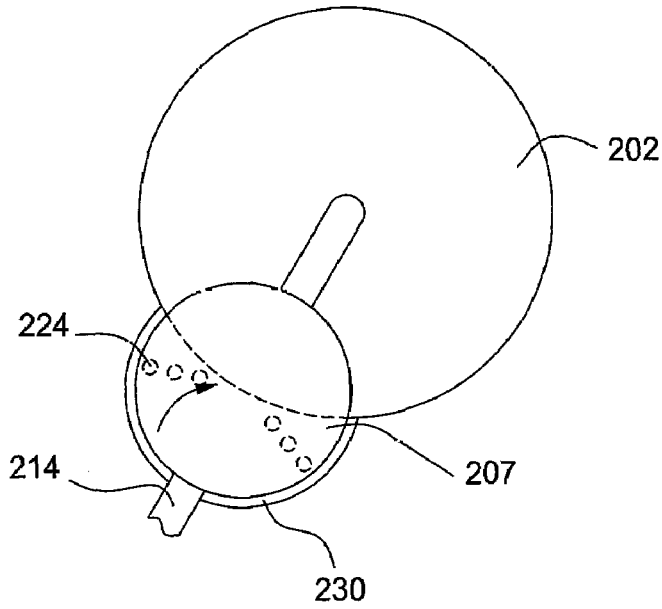
FIG. 7B illustrates a partial top view of the polishing system of FIG. 6 in a washing position.

FIG. 7A illustrates one of the polishing station 202 and the wash station 230 in a polishing position, where the substrate head 207 is positioned above the polishing station 202. FIG. 7B illustrates one of the polishing station 202 and the wash station 230 in a cleaning position, where the substrate head 207 is positioned above the partial circular processing surface of the wash station 230. During cleaning, the substrate head 207 rotates the substrate being cleaned so that the substrate surface may be evenly exposed to the partial circular processing surface.

It should be noted that although only polishing systems with a six headed carousel, four polishing stations and two load cups is illustrated in the Figures, a person skilled in the art may also derive polishing system with other configurations to have similar advantages. For example, a polishing system having a nine headed carousel, six polishing stations and three load cups, and centers of the six polishing stations and three load cups form a non perfect polygon. Additionally, the wash station may be positioned in other locations relative to the polishing stations. For example, the wash stations may be positioned outside the polygon formed by the polishing stations and the load cups. The wash stations may have other proper design structures to fit in the system.

While the foregoing is directed to embodiments of the present invention, other and further embodiments of the invention may be devised without departing from the basic scope thereof, and the scope thereof is determined by the claims that follow.

What is claimed is:

1. An apparatus for polishing a substrate, comprising:

a base;

four polishing stations disposed on the base;

two load cups disposed on the base;

a wash station disposed on the base adjacent to one of the four polishing station; and a carousel rotatable about a carousel axis and supported by the base, wherein the carousel comprises six substrate heads, each configured to receive and support the substrate, and each of the six substrate heads alignable to any of the four polishing stations, the two load cups and the wash station, wherein the carousel is configured to simultaneously align the six substrate heads with the four polishing stations and the two load cups.

2. The apparatus of claim 1, wherein the substrate heads are configured to move between the wash station and the one of the polishing stations when the substrate heads are aligned with the wash station.

3. The apparatus of claim 1, wherein a radial movement of the substrate heads enable the substrate heads to move between the wash station and the one of the polishing stations.

4. The apparatus of claim 1, wherein the four polishing stations and the two load cups form a hexagon around the carousel axis and the wash station is positioned inside the hexagon.

5. The apparatus of claim 1, wherein the wash station has a circular processing surface configured to receive a surface of the substrate being processed.

6. The apparatus of claim 1, wherein the wash station has a partial circular processing surface configured to receive a surface of the substrate being processed.

7. The apparatus of claim 1, wherein the wash station comprises a spray nuzzle configured to spray a cleaning solution.

8. The apparatus of claim 1, wherein the wash station comprises a buffing pad configured to be in contact with a surface of the substrate being processed.

9. The apparatus of claim 1, wherein the two load cups are adapted to clean the substrate.

10. The apparatus of claim 1, further comprising:

a fifth polishing station disposed adjacent to the base;

a third load cup disposed adjacent to the fifth polishing station;

a seventh substrate head movable between the fifth polishing station and the third load cup; and a robot capable of transferring substrates to and from the two load cups and the third load cup.

11. The apparatus of claim 10, further comprising:

a sixth polishing station disposed adjacent to the base;

a fourth load cup disposed adjacent to the sixth polishing station; and an eighth substrate head movable between the sixth polishing head and the fourth load cup, wherein the robot is capable of transferring substrates to and from the eighth substrate head.

12. A polishing system, comprising:

a base;

four polishing stations disposed on the base;

two load cups disposed on the base;

a first wash station and a second wash station positioned on the base;

a carousel rotatable about a carousel axis and supported by the base, wherein the carousel comprises six substrate heads, each configured to receive and support a substrate, and each of the six substrate heads alignable to any of the polishing stations, load cups, and the wash stations.

13. The polishing system of claim 12, wherein the six substrate heads are mounted on a carousel base at equal angular intervals about the carousel axis, wherein each of the substrate heads is radially movable relative to the carousel axis.

14. The polishing system of claim 12, wherein the substrate heads are configured to move between the wash stations and the corresponding polishing stations or the load cups when the substrate heads are aligned with the polishing stations or the load cups.

15. The polishing system of claim 12, wherein each of the substrate heads aligns with the four polishing stations, the first and second wash stations and the two load cups using a combination of radial movement of the substrate heads and rotational movement of the carousel.

16. The polishing system of claim 15, wherein the four polishing stations and the two load cups form a non perfect polygon, and the first and second wash stations are positioned inside the polygon.

17. A method for polishing substrate, comprising:

providing a polishing system having at least six substrate heads mounted on a carousel;

loading a substrate on one of the substrate heads aligned with a load cup;

aligning the substrate with a polishing station;

polishing the substrate in the polishing station;

moving the substrate head radially to align with a wash station; and washing the substrate in the wash station.

18. The method of claim 17, wherein the aligning the substrate comprises:

rotating the carousel; and moving the substrate radially.

19. The method of claim 17, further comprising:

upon finishing washing the substrate in the wash station, rotating the carousel and moving the substrate radially to align with another polishing station; and polishing the substrate in the another polishing station.

20. The method of claim 17, further comprising:

prior to loading the substrate in the substrate head, loading the substrate on a stand alone substrate head;

polishing the substrate in the stand alone polishing station;

releasing the substrate from the stand alone polishing station to a stand alone load cup; and moving the substrate from the stand alone load cup to the load cup.

21. The method of claim 17, further comprising:

while loading the substrate on the substrate head, simultaneously loading another substrate on another substrate head of the at least six substrate heads by aligning the another substrate head with another load cup.

22. The method of claim 17, further comprising cleaning the substrate in the load cup.

* * * * *

UNITED STATES PATENT AND TRADEMARK OFFICE

CERTIFICATE OF CORRECTION

PATENT NO. : 7,241,203 B1
APPLICATION NO. : 11/608588
DATED : July 10, 2007
INVENTOR(S) : Hung Chih Chen and Simon Yavelberg It is certified that error appears in the above-identified patent and that said Letters Patent is hereby corrected as shown below:

Column 11, line 23, please replace “nuzzle” with --nozzle.--

Signed and Sealed this

Sixth Day of November, 2007

JON W. DUDAS
*Director of the United States Patent and Trademark Office*